US008555572B1

(12) United States Patent
Bingham et al.

(10) Patent No.: US 8,555,572 B1
(45) Date of Patent: Oct. 15, 2013

(54) STORM WINDOW ASSEMBLY AND METHODS OF USE

(76) Inventors: Glenn Bingham, Conifer, CO (US); Lynn Bingham, Conifer, CO (US)

( * ) Notice: Subject to any disclaimer, the term of this patent is extended or adjusted under 35 U.S.C. 154(b) by 408 days.

(21) Appl. No.: 12/907,905

(22) Filed: Oct. 19, 2010

Related U.S. Application Data

(60) Provisional application No. 61/254,175, filed on Oct. 22, 2009.

(51) Int. Cl.
*E06B 3/26* (2006.01)

(52) U.S. Cl.
USPC ..... 52/202; 52/DIG. 12

(58) Field of Classification Search
USPC ..... 52/202, 203, 204.51, 204.6, DIG. 12; 49/61, 62, 416
See application file for complete search history.

(56) References Cited

U.S. PATENT DOCUMENTS

| | | | | | |
|---|---|---|---|---|---|
| 1,264,334 | A | * | 4/1918 | Richer | 49/62 |
| 1,804,741 | A | * | 5/1931 | Butzbach | 52/202 |
| 1,826,203 | A | * | 10/1931 | Cunningham | 52/202 |
| 2,201,126 | A | | 5/1940 | Rosenberg | |
| 2,453,992 | A | * | 11/1948 | Kleintop | 160/182 |
| 2,607,964 | A | * | 8/1952 | Shook | 52/204.51 |
| 2,999,279 | A | * | 9/1961 | Lauer | 49/434 |
| 3,280,889 | A | | 10/1966 | Wahfeld et al. | |
| 3,981,101 | A | | 9/1976 | Guzzi | |
| 4,028,849 | A | | 6/1977 | Anderson | |
| 4,144,674 | A | | 3/1979 | Dovman | |
| 4,186,522 | A | | 2/1980 | Hooks | |
| 4,238,907 | A | | 12/1980 | Swan | |
| 4,274,468 | A | | 6/1981 | McPhail | |
| 4,275,526 | A | | 6/1981 | Abramson | |
| 4,304,072 | A | | 12/1981 | Pegg | |
| 4,333,283 | A | * | 6/1982 | Ebata | 52/202 |
| 4,363,351 | A | * | 12/1982 | Eriksen | 160/187 |
| 4,385,470 | A | | 5/1983 | Bryson | |
| 4,432,179 | A | * | 2/1984 | Bachmann | 52/204.593 |
| 4,470,222 | A | * | 9/1984 | Killingsworth | 49/419 |
| 4,503,641 | A | * | 3/1985 | Swan | 49/445 |
| 4,558,536 | A | * | 12/1985 | Dunsmoor | 49/404 |
| 4,590,708 | A | | 5/1986 | Campodonico | |
| 4,599,836 | A | | 7/1986 | Melcher | |
| 4,807,419 | A | * | 2/1989 | Hodek et al. | 52/786.1 |
| 5,301,734 | A | | 4/1994 | Opel | |
| 5,325,579 | A | | 7/1994 | Baier | |
| 5,373,671 | A | | 12/1994 | Roth | |
| 5,410,846 | A | | 5/1995 | Frambach | |
| 5,803,145 | A | | 9/1998 | Lamb | |
| 6,481,159 | B2 | | 11/2002 | Diston | |
| 6,618,998 | B1 | | 9/2003 | Thomas | |
| 6,679,002 | B2 | | 1/2004 | Davies | |
| 6,802,156 | B2 | | 10/2004 | Sherrett | |
| 6,857,228 | B2 | | 2/2005 | Kunz | |
| 7,146,769 | B1 | | 12/2006 | Culverson | |
| 7,237,365 | B1 | | 7/2007 | Phandanouvong | |
| 2002/0162278 | A1 | | 11/2002 | Demars | |
| 2003/0019173 | A1 | | 1/2003 | Martin | |
| 2003/0041537 | A1 | | 3/2003 | Glover | |
| 2003/0121618 | A1 | | 7/2003 | Ralph | |
| 2006/0054286 | A1 | | 3/2006 | Woodward | |
| 2006/0059780 | A1 | | 3/2006 | Petta | |
| 2007/0199665 | A1 | | 8/2007 | Studney | |
| 2008/0271394 | A1 | | 11/2008 | Hand | |

* cited by examiner

*Primary Examiner* — Christine T Cajilig
(74) *Attorney, Agent, or Firm* — Albert Haegele; Leyendecker & Lemire, LLC

(57) ABSTRACT

A storm window assembly having an internal counterbalance, multiple panes, and multiple sashes is described. The storm window assembly is relatively thin, and is thus adapted to fit in a vintage wood window while preserving a traditional look from a building exterior. Embodiments of the storm window assembly typically include two insulated sashes, each insulated sash having two glass panes that bound a gas tight compartment. The storm window assembly further includes a counterbalance concealed within.

17 Claims, 9 Drawing Sheets

STORM WINDOW ASSEMBLY AND METHODS OF USE

This application claims priority to, and incorporates by reference, U.S. provisional patent application No. 61/254,175 filed on 22 Oct. 2009. The provisional patent application referred to above has the same title and inventors as the present application.

FIELD OF THE INVENTION

The present invention relates generally to storm window assemblies adapted to installation in vintage wood windows having narrow storm window tracks.

BACKGROUND

Vintage wood windows are single or double hung, wood windows that have a distinctive look, which many people find desirable. However, vintage wood windows generally insulate poorly, and thus can contribute to building energy inefficiency. Moreover, conventional storm windows for vintage wood windows also insulate relatively poorly, typically comprising sashes that are single pane. Moreover, the single pane storm windows are typically not adapted to be opened and closed. When a conventional storm window is installed it is "closed" until it is uninstalled.

Vintage wood windows typically have relatively narrow shelves or tracks into which screens or conventional single pane storm windows can be installed. The narrow receiving shelves are approximately 1.0625 inch (1 1/16") to 1.1250 inch (1 1/8") wide, and are therefore too narrow for conventional multi-pane, multi-sash storm window assemblies to fit within. While a thicker multi-pane or multi-sash storm window assembly could arguably be placed in a narrow receiving shelf of a vintage wood window, the thicker storm window assembly would project too far beyond the vintage wood window exterior surface, thereby detracting from a traditional appearance. In addition, multi-pane windows tend to be relatively heavy, which makes opening and closing vertically sliding windows difficult.

While installation of counter balance systems would facilitate opening and closing relatively heavy multi-pane windows, a conventional storm window assembly with a counterbalance installed would be even thicker, and would thus project even more beyond the vintage wood window exterior surface. Therefore, in order to preserve a traditional appearance, even brand new prior art storm window assemblies installed in vintage wood windows tend to be relatively poorly insulated assemblies comprising single pane windows.

DETAILED DESCRIPTION

Figure 1:
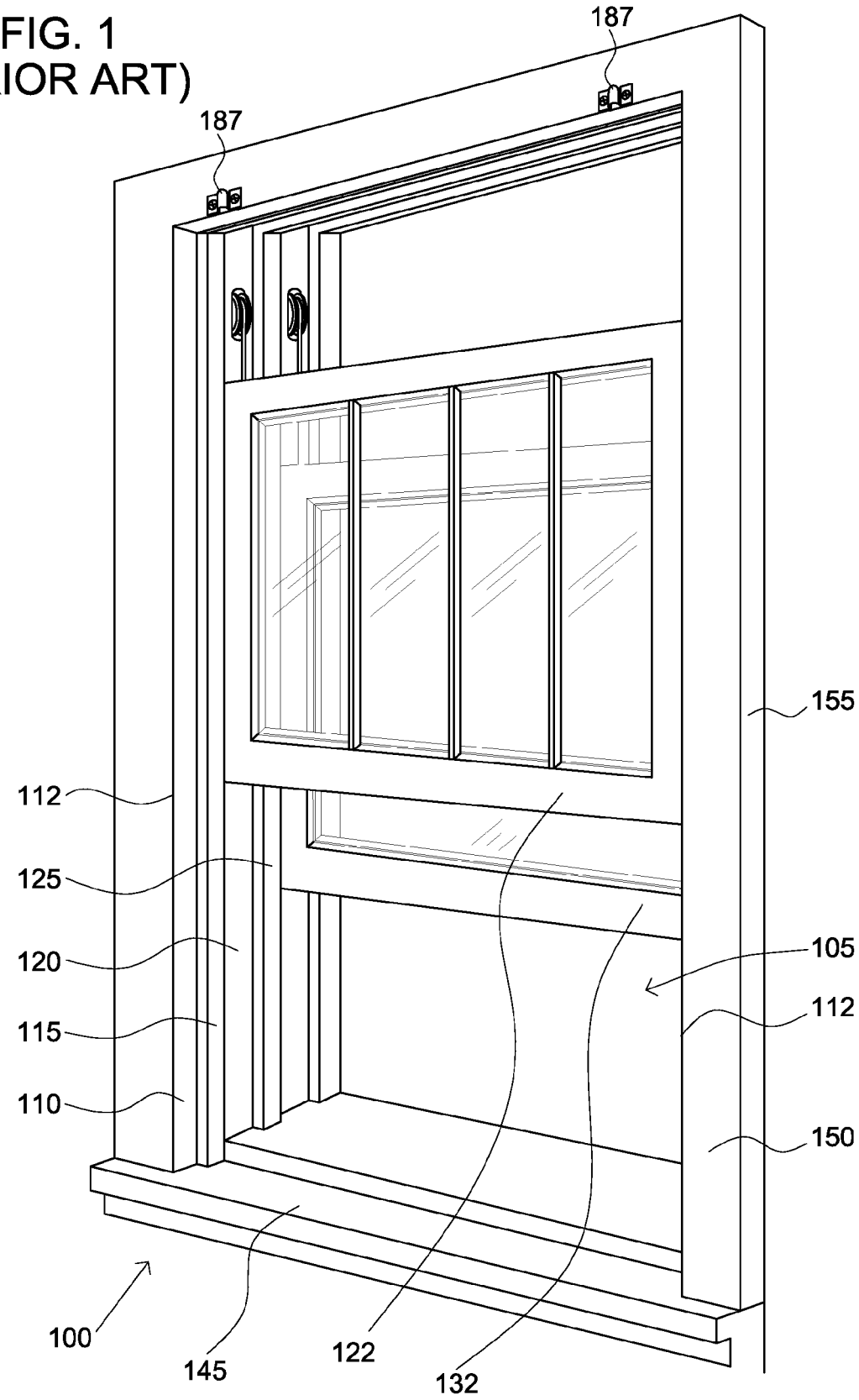
FIG. 1 (PRIOR ART)
FIG. 1 is an exterior perspective view of a vintage wood window.

Embodiments of the present invention comprise a storm window assembly adapted to install in a vintage wood window and to present an appearance similar to older style single pane storm windows. The storm window assembly is typically a single hung window assembly having two multiple pane window pane assemblies, one of which is adapted to be opened by moving vertically, sliding in a track as it moves.

The storm window assembly fits into a receiving shelf in the vintage wood window, with a peripheral flange residing approximately flush with brick mold that serves as the vintage wood window's exterior trim. An exterior ridge of the storm window assembly projects exteriorly (toward a building exterior) about 0.50 inch (½") or less beyond the peripheral flange. Thus the storm window assembly preserves a traditional appearance of an original vintage wood window.

However, in contrast to older style single pane storm windows, which tend to be poorly insulated and drafty, the storm window assembly of the present invention possesses advantages afforded by modern materials and design. The advantages include, but are not limited to, increased insulation resulting from multi-pane window pane assemblies comprising two panes separated by a sealed cavity. Accordingly, embodiments of the storm window assembly offer unprecedented energy efficiency compared to prior art storm windows used with vintage wood windows.

The two panes are typically glass panes, and the sealed cavity may be bisected by a third pane. The third pane typically, but not necessarily, comprises a thin polymeric film. The sealed cavity is typically gas filled. In some embodiments, the sealed cavity is partially evacuated so that the sealed cavity is at reduced pressure relative to atmospheric pressure.

Embodiments of the storm window assembly comprise a multi-pane window pane assembly, sometimes referred to as a sliding storm sash, adapted to slide in a linear wooden track, which allows the storm window assembly to open and close. The storm window assembly typically comprises another multi-pane window pane assembly, sometimes referred to as a fixed sash, that is fixed in place in the storm window assembly, and which the sliding storm sash slides past in the linear wooden track. Because the multi-pane window pane assemblies tend to be relatively heavy, a concealed channel balance is employed to ease raising and lowering the sliding storm sash within the storm window assembly.

Except for glass panes and metal channel balances, embodiments of the storm window assembly consist essentially of wood.

Terminology

The terms and phrases as indicated in quotation marks (" ") in this section are intended to have the meaning ascribed to them in this Terminology section applied to them throughout this document, including in the claims, unless clearly indicated otherwise in context. Further, as applicable, the stated definitions are to apply, regardless of the word or phrase's case, to the singular and plural variations of the defined word or phrase.

The term "or" as used in this specification and the appended claims is not meant to be exclusive; rather the term is inclusive, meaning either or both.

References in the specification to "one embodiment", "an embodiment", "another embodiment, "a preferred embodiment", "an alternative embodiment", "one variation", "a variation" and similar phrases mean that a particular feature, structure, or characteristic described in connection with the embodiment or variation, is included in at least an embodiment or variation of the invention. The phrase "in one embodiment", "in one variation" or similar phrases, as used in various places in the specification, are not necessarily meant to refer to the same embodiment or the same variation.

The term "couple" or "coupled" as used in this specification and appended claims refers to an indirect or direct connection between the identified elements, components, or objects. Often the manner of the coupling will be related specifically to the manner in which the two coupled elements interact.

Directional or relationary terms such as, but not limited to, up, down, interior, exterior, top, and bottom are relative to each other and are dependent on the orientation a window or window assembly when installed in a substantially vertical wall of a building. Where the window or window assembly is not installed, the directional or relationary terms are interpreted as if the window or window assembly is installed in a substantially vertical wall of a building. Thus a window or window assembly has interior and exterior sides even when not installed, because the window or window assembly has a particular orientation in which it is designed to be installed, in which one side is designed to face a building exterior, and one side is designed to be face a building interior.

As applicable, the term "about," as used herein unless otherwise indicated, means a margin of +−20%. It is to be appreciated that not all use of the above term are is quantifiable such that the referenced range can be applied.

The term "about," as used in this specification and appended claims, refers to plus or minus 20% of the value given.

The terms "generally," or "substantially," as used in this specification and appended claims, mean mostly, or for the most part.

The term "approximately," as used in this specification and appended claims, refers to plus or minus 10% of the value given.

The term "interior-exterior axis," as used in this specification and appended claims, refers to an axis that extends through a window or window assembly between the window or window assembly exterior side and the window or window assembly interior side. The interior-exterior axis is perpendicular to a plane in which window panes of the window or window assembly reside.

The term "inward-outward axis," as used in this specification and appended claims, refers to an axis extending through a window or window assembly in or approximately parallel to a plane in which window panes of the window or window assembly reside.

The term "interiorly," as used in this specification and appended claims, refers to a direction along an interior-exterior axis. The direction to which "interiorly" refers is from the window or window assembly exterior side toward the window or window assembly interior side.

The term "exteriorly," as used in this specification and appended claims, refers to a direction along an interior-exterior axis. The direction to which "exteriorly" refers is from the window or window assembly interior side toward the window or window assembly exterior side.

The terms "inward" and "inwardly," as used in this specification and appended claims, refer to a direction along an inward-outward axis. The direction to which "inward" and "inwardly" refer is from outside a window frame toward a window opening.

The terms "outward" and "outwardly," as used in this specification and appended claims, refer to a direction along an inward-outward axis. The direction to which "outward" and "outwardly" refer is from within a window opening to outside a window frame.

The terms "thick" and "thickness," as used in this specification and appended claims, refers to a dimension of a storm window assembly or component thereof along an interior-exterior axis, where the dimension of the storm window assembly or component is greatest.

The terms "sash," "sashes," "window sashes," and similar terms, as used in this specification and appended claims, refer to a pane and a framework, the pane being set into the framework and the framework circumscribing a periphery of the pane. The sash or sashes typically reside, either fixed or moveable, within a larger window frame. Some sashes comprise multiple panes. Panes typically, but not necessarily, consist essentially of plate glass. Some panes consist essentially of plates or sheets of polymeric material, and variations include thin polymeric films.

The term "window opening," as used in this specification and appended claims, refers to an area or space circumscribed by a window frame. Window sashes and screens typically reside substantially within a window opening.

The term "window or window assembly," as used in this terminology section, refers to fixed windows, single hung windows, and double hung windows, wherein window sashes are fixed or slide along a track, but do not tilt or swing out.

The term "vintage wood window," as used in this specification, refers to an "all-wood" window manufactured prior to 1945. Vintage wood windows are single or double hung. "All-wood" means that other than glass and balance components, vintage wood windows consist essentially of wood.

The term "brick mold," as used in this specification and appended claims, refers to exterior trim familiar to persons of ordinary skill in the art. Commonly referred to as brick mold, brick mould, brick molding, or brick moulding, this exterior trim typically spans a gap between a door frame or window frame and a structure in which the door frame or window frame resides. As used here, brick mold or similar exterior trim is considered part of a vintage wood window.

A Vintage Wood Window

Figure 2:
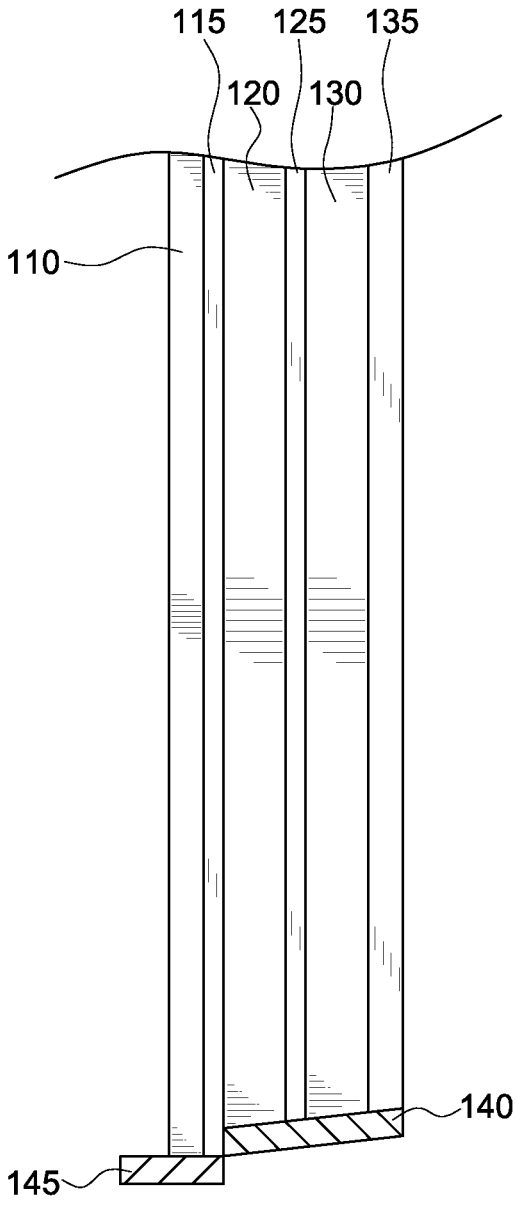
FIG. 2 (PRIOR ART)
FIG. 2 is a plan view of a frame of a vintage wood window, as viewed from inside a window opening.

A vintage wood window 100, into which a storm window assembly according to the present invention is adapted to be installed, is illustrated in FIGS. 1 and 2. FIG. 1 is illustrated as viewed from a building exterior, the vintage wood window being installed in the building. FIG. 2 is illustrated as viewed from within a window opening 105 of a vintage wood window, with window units removed, and showing a sill 140 and sub-sill 145 cross section.

The vintage wood window 100 comprises a receiving shelf 110, into which a storm window assembly fits when installed in the vintage wood window. The receiving shelf is approximately 1.0625 inch (1 1/16") to 1.125 inch (1 1/8") width. An exterior edge 112 of the receiving shelf is approximately flush with an exterior surface 150 of external trim 155 of the vintage wood window. The external trim of the vintage wood window illustrated n FIGS. 1 and 2 is brick mold. Thickness of the external trim and the receiving shelf width are approximately the same, the external trim thickness defining the receiving shelf width. Accordingly, the thickness of the external trim is 1.0625 inch (1 1/16") to 1.125 inch (1 1/8"). The width of the receiving shelf is best illustrated in the plan view illustrated in FIG. 2.

An exterior stop 115 (also referred to as a blind stop) bounds the receiving shelf 110 interiorly, the exterior stop comprising a ridge that projects inwardly into the window opening. Adjacent to the exterior stop is an exterior jam track 130, which is bounded by the exterior stop and a similar inwardly projecting ridge that forms a parting stop 125. Adjacent to the parting stop is an interior jam track 130, which is bounded by the parting stop and an interior stop 135. The interior stop comprises an inwardly projecting ridge that is similar to, but typically somewhat wider than, the exterior stop 115 and the parting stop 125. The vintage wood window 100 further comprises the sill 140 and sub-sill 145.

FIG. 1 illustrates a vintage wood window with primary window panels installed, the primary window comprising an exterior sash 122 and an interior sash 132. The exterior sash resides in the exterior jam track 120, and is adapted to slide vertically in the exterior jam track during opening and closing of the primary window. The interior sash resides in the interior jam track 130, and is adapted to slide vertically in the interior jam track to facilitate opening the primary window. Also shown in FIG. 1 are counterbalance pulleys 160 that assist in raising and lowering the primary window panels, and exterior trim 150. Some vintage wood windows are single hung, in which case only one primary window panel is adapted to slide vertically in a jam track.

The vintage wood window further comprises hangers 187 adapted to engage complementary hanger receivers on a storm window assembly.

A First Embodiment Storm Window Assembly

A first embodiment storm window assembly 270 is illustrated in FIGS. 3-8. The first embodiment storm window assembly comprises a first pane assembly 272, a second pane assembly 274, and a screen 276. The second pane assembly resides within a sliding storm sash 275. The sliding storm sash further comprises a concealed channel balance 278 (see FIG. 7), and is adapted to slide along a linear track 279 within a track housing 280 in order to open and close.

Figure 4:
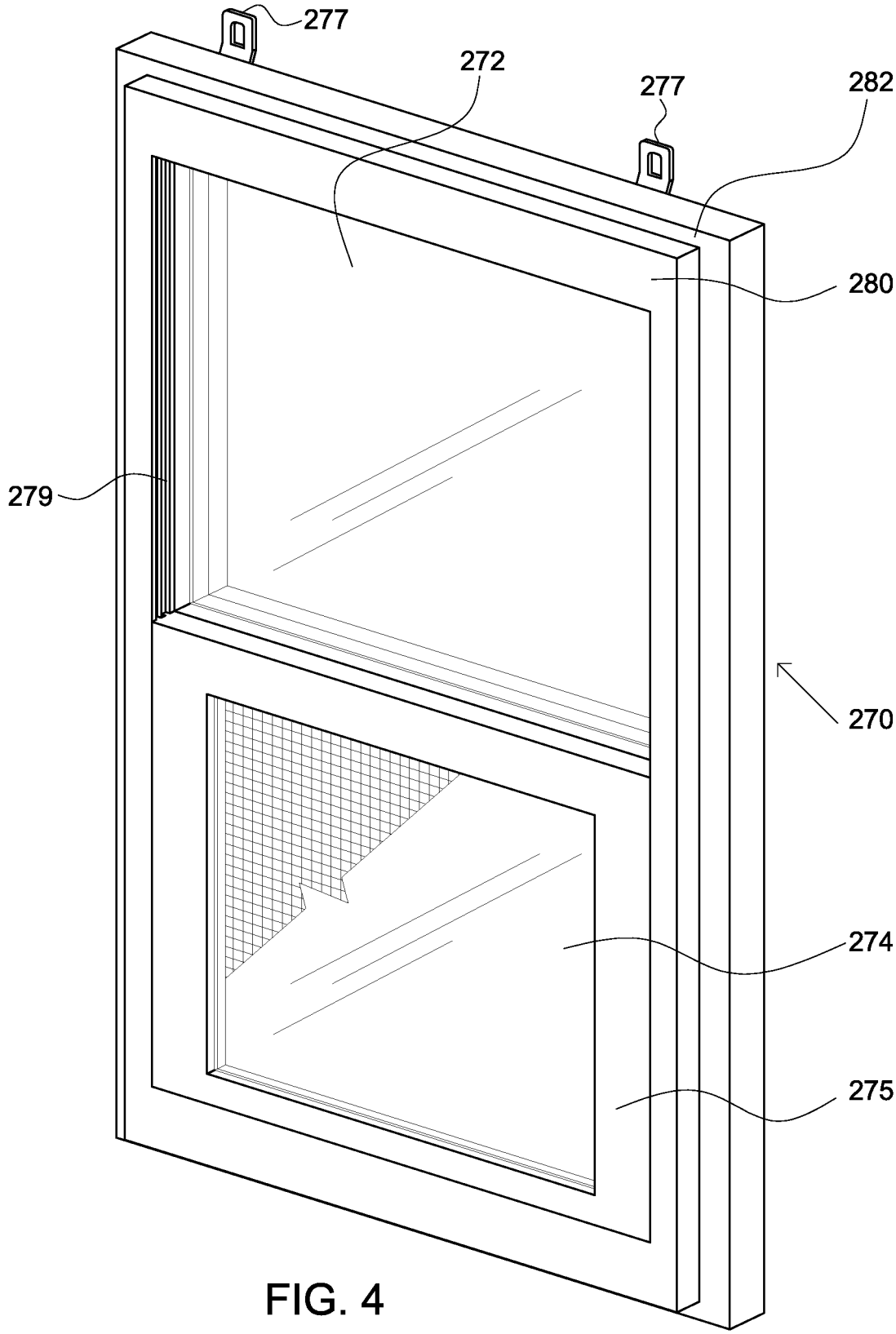
FIG. 4 is an interior perspective view of a storm window assembly according to one embodiment of the present invention.
Figure 5:
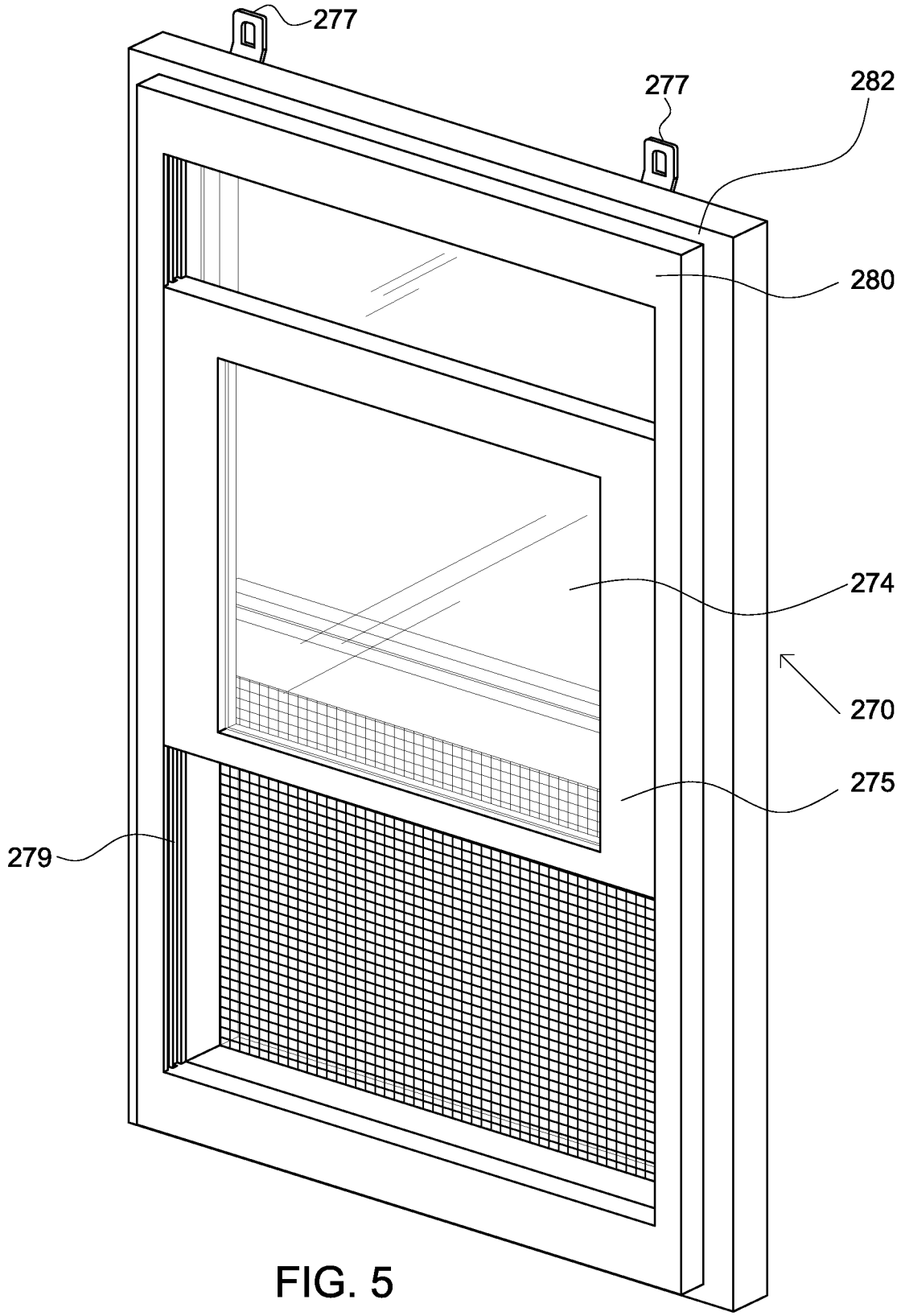
FIG. 5 is an interior perspective view of a storm window assembly according to one embodiment of the present invention.
Figure 6:
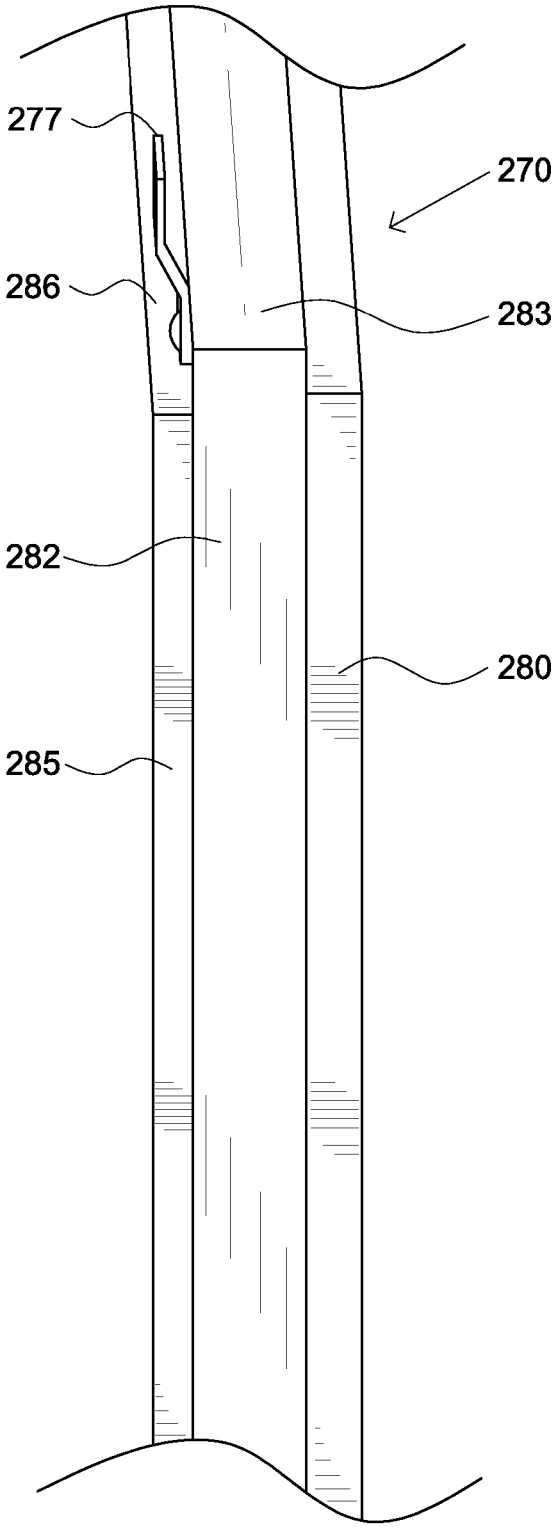
FIG. 6 is a side view of an upper corner of a storm window assembly according to one embodiment of the present invention.

The first embodiment storm window assembly 270 further comprises a peripheral flange 282, best shown in FIGS. 4-6. The peripheral flange has a flange width 283 that falls in a range of approximately 1.0625 inch (1 1/16") to 1.1250 inch (1 1/8"). Accordingly, the flange width of the peripheral flange matches the width of the receiving shelf (structure 110 in FIGS. 1 and 2) of a vintage wood window, and the storm window assembly is thus adapted to fit in the vintage wood window receiving shelf. Embodiments of the storm window assembly include weather stripping installed on an interior vertical surface of the peripheral flange. The weather stripping is adapted to seal against a receiving shelf of a vintage wood window in which the storm window assembly is installed. Examples of weather stripping include, but are not limited to, compression bulb weather stripping and felt pile weather stripping.

Figure 3:
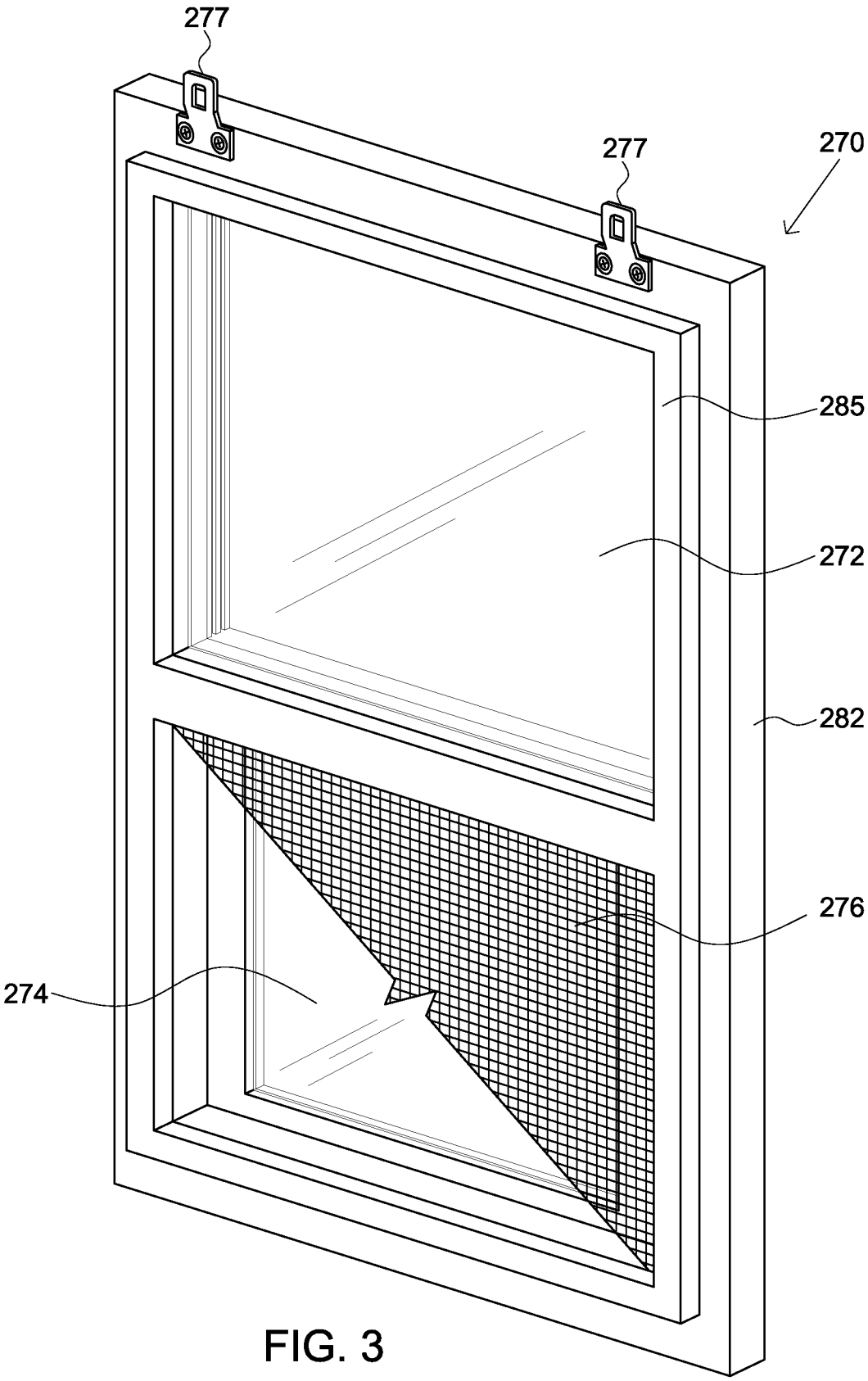
FIG. 3 is an exterior perspective view of a storm window assembly according to one embodiment of the present invention.

As best viewed in FIGS. 3, 4, and 6, the track housing 280 projects interiorly from the peripheral flange preferably about 0.625 inch (5/8") to about 0.875 inch (7/8"), and more preferably approximately 0.75 inch (3/4"). The linear track consists essentially of wood.

Figure 7:
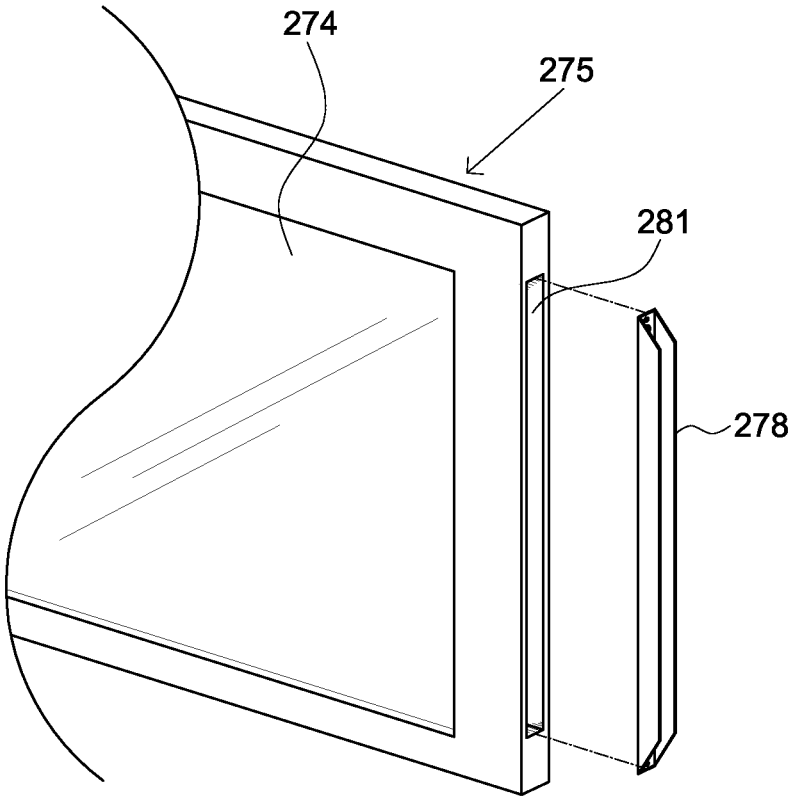
FIG. 7 is a side perspective view of a sliding storm sash according to one embodiment of the present invention.

The second pane assembly 274 is approximately 0.625 inch (5/8") thick, and the sliding storm sash is approximately 0.875 inch (7/8") thick. The concealed channel balance 278 of the first embodiment storm window assembly resides in a balance cavity 281 in the storm sash 275, as best illustrated in FIG. 7. The balance cavity is approximately 0.625 inch (5/8") wide, which provides just enough clearance for installation of the channel balance, and requires very precise routing in order to create the channel in the storm sash, which is only approximately 0.875 inch (7/8") thick. The concealed channel balance of the first embodiment storm window assembly is a 60 series channel balance from STRYBUC INDUSTRIES®, Sharon Hill, Pa. Other embodiments may comprise other types of channel balances or similar block and tackle pulley systems comprising a spring housed inside a channel.

The first embodiment storm window assembly 272 further comprises an exterior ridge 285. The exterior ridge projects exteriorly beyond the peripheral flange preferably 0.25 inch (1/4") to 0.50 inch (1/2") and more preferably about 0.4375 inch (7/16"). Where the storm window assembly is installed in a vintage wood window, the exterior ridge projects exteriorly beyond brick mold or similar exterior trim by the same amount; preferably 0.25 inch (1/4") to 0.50 inch (1/2") and more preferably about 0.4375 inch (7/16").

Thickness of the storm window assembly, measured from an interior-most portion of the track housing 280 to an exterior-most portion of the exterior ridge 285, is preferably less than 2.625 inches (2 5/8"), more preferably less than 2.375 inches (2 3/8"), and most preferably 2.1875 inches (2 3/16"), plus or minus 0.0625 inch (1/16").

As illustrated in FIG. 4, the sliding storm sash 275 is in a closed orientation at a bottom most position in its travel within the track housing 285. FIG. 5 illustrates the sliding storm sash in an open position, the sliding storm sash having moved upwardly within the track housing and sliding partially beside the first pane assembly in so moving. The storm window assembly further comprises a screen 276.

Each of the first pane assembly 272 and the second pane assembly 272 comprise two glass panes separated by a sealed, gas filled internal space. The sealed, gas filled internal space is divided into two compartments by a third pane, the third pane comprising a thin polymeric film, and the gas filled internal space can comprise gas or gas mixtures having insulating properties greater than air. Such gas includes, but is not limited to, inert gas such as argon or krypton. In some embodiments, the internal space is partially evacuated, resulting in reduced gas pressure in the internal space that is below atmospheric pressure.

The first embodiment storm window assembly 272 further comprises an exterior ridge 285. The exterior ridge projects exteriorly beyond the peripheral flange preferably 0.25 inch (1/4") to 0.50 inch (1/2") and more preferably about 0.4375 inch (3/8"). Where the storm window assembly is installed in a vintage wood window, the exterior ridge projects exteriorly beyond brick mold or similar exterior trim by the same amount; preferably 0.25 inch (1/4") to 0.50 inch (1/2") and more preferably about 0.4375 inch (3/8").

The first embodiment storm window assembly further comprises hanger receivers 277 adapted to engage hangers 187 (see FIGS. 1 and 2) on vintage wood windows where the storm window assembly is installed in a vintage wood window.

Figure 8:
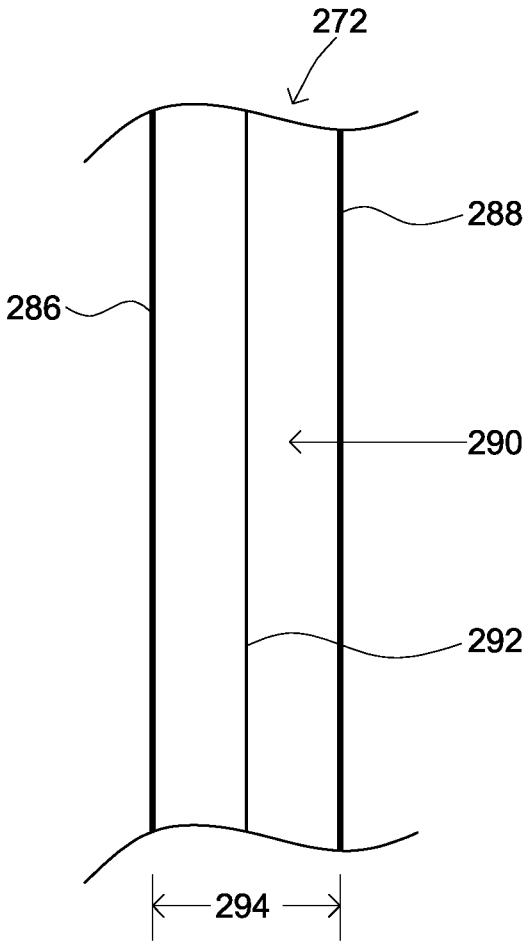
FIG. 8 is a cross-section view of a triple pane window unit according to one embodiment of the present invention.
Figure 9:
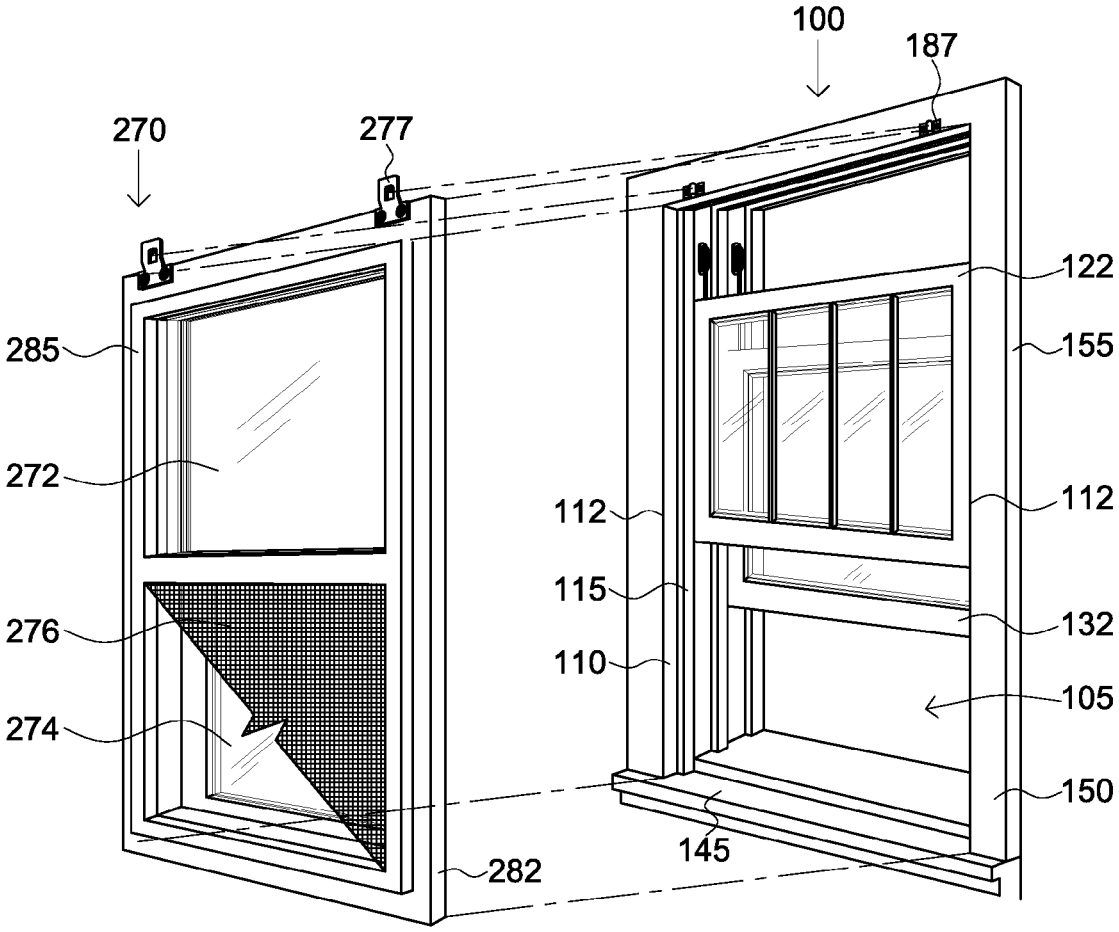
FIG. 9 is an exploded, exterior, perspective view of a storm window assembly installed on vintage wood window, according to one embodiment of the present invention.

A cross section of the first pane assembly 272 is illustrated in FIG. 8. The first pane assembly comprises a first glass pane 286 and a second glass pane 288, between which a sealed cavity 290 resides. The sealed cavity is filled with argon or krypton and is bisected by a third pane 292, which is a polymeric film, also known as a suspended coated film. A pane assembly thickness 294 of the first pane assembly is preferably less than 0.75 inch (3/4"), more preferably less than 0.6875 inch (11/16"), and most preferably approximately 0.625 inch (⅝"). The first pane assembly comprises Serious Glass™ manufactured by Serious Materials™. Other embodiments have other gasses in the sealed cavity, including but not limited to, air. Some embodiments have sealed cavities within which resides reduced gas pressure relative to atmospheric pressure.

The first embodiment storm window assembly has an R value preferably greater than 1.75, more preferably greater than 2.5, and most preferably between 3.0 and 4.0. When installed in a vintage wood window, the storm window assembly and vintage wood window in combination have an R-value preferably greater than 3.50, more preferably greater than 4.5, and most preferably between 4.5 and 6.0.

Alternative Embodiments and Variations

The various embodiments and variations thereof, illustrated in the accompanying Figures and/or described above, are merely exemplary and are not meant to limit the scope of the invention. It is to be appreciated that numerous other variations of the invention have been contemplated, as would be obvious to one of ordinary skill in the art, given the benefit of this disclosure. All variations of the invention that read upon appended claims are intended and contemplated to be within the scope of the invention.

We claim:

1. A storm window assembly comprising:

a first pane assembly and a second pane assembly, each of the first pane assembly and the second pane assembly including two or more glass panes, at least two of the two or more glass panes being separated by a sealed, gas filled space;

a sliding storm sash, the sliding storm sash including the second pane assembly and being adapted to slide along a linear track;

a channel balance, the channel balance residing substantially within the sliding storm sash;

a peripheral flange, the peripheral flange extending radially outwardly around a storm window assembly periphery and having a flange thickness in a range of approximately 1.0625 inch to 1.125 inch, the flange thickness residing along an interior-exterior axis; and an exterior ridge, wherein the two or more glass panes of the first pane assembly are rectangular and the exterior ridge resides around at least three sides of the first pane assembly and projects exteriorly 0.25 inch to 0.50 inch beyond the peripheral flange, wherein the peripheral flange extends radially outwardly beyond the exterior ridge, and a thickness of the storm window assembly, measured from an exterior-most portion of the exterior ridge to an interior-most portion of the storm window assembly, is less than 2.625 inches.

2. The storm window assembly of claim 1, wherein the sliding storm sash is about 0.875 inch thick.

3. The storm window assembly of claim 2, further comprising a track housing, wherein:

the two or more glass panes of the second pane assembly are rectangular and the track housing resides around at least three sides of the second pane assembly and projects interiorly 0.625 inch to 0.875 inch beyond the peripheral flange; and the interior-most portion of the storm window assembly is an interior-most portion of the track housing.

4. The storm window assembly of claim 3, wherein the each of the first pane assembly and the second pane assembly further comprise a third pane, the third pane residing between the at least two of the two or more glass panes.

5. The storm window assembly of claim 4, wherein the storm window assembly has an R rating greater than 1.75.

6. The storm window assembly of claim 4, wherein the storm window assembly has an R rating greater than 2.5.

7. The storm window assembly of claim 5, wherein the first pane assembly is fixed within the storm window assembly, and the sliding storm sash is adapted to slide alongside the first pane assembly.

8. The storm window assembly of claim 7, wherein the third pane comprises a polymeric film.

9. The storm window assembly of claim 5, wherein the storm window assembly consists essentially of wood, except for the channel balance and the first and second pane assemblies.

10. A window system comprising:

a vintage wood window, the vintage wood window including:

an exterior jam track, the exterior jam track being bounded on an exterior side by an exterior stop and on an interior side by a parting stop;

a receiving shelf, the receiving shelf (i) being substantially horizontal, (ii) residing exteriorly from an outside jam track, and (iii) being bounded on an interior side by an exterior stop;

an exterior sash, the exterior sash comprising a glass pane and being adapted to slide along the exterior jam track;

an interior sash, the interior sash comprising a glass pane and being adapted to slide along the interior jam track; and the storm window assembly of claim 1, the peripheral flange of the storm window assembly residing in the receiving shelf.

11. The window system of claim 10, wherein the window assembly has an R value greater than 3.5.

12. The window system of claim 10, wherein the window assembly has an R value greater than 4.5.

13. The window system of claim 10, wherein the storm window assembly consists essentially of wood, except for the channel balance and the first and second pane assemblies.

14. The window system of claim 10, wherein the each of the first pane assembly and the second pane assembly further comprise a third pane, the third pane residing between the at least two of the two or more glass panes.

15. The window system of claim 10, wherein the receiving shelf comprises exterior trim, the exterior trim residing exteriorly to the exterior stop.

16. The window system of claim 10, wherein a width of the receiving shelf is 1.0625 inch to 1.125 inch.

17. A method of using a storm window assembly comprising:

providing the storm window assembly, wherein a thickness of the storm window assembly is less than 2.625 inches, the storm window assembly including:

a first pane assembly and a second pane assembly, each of the first pane assembly and the second pane assembly including two or more glass panes, at least two of the two or more glass panes being separated by a sealed, gas filled space;

a sliding storm sash, the sliding storm sash including the second pane assembly;

a channel balance, the channel balance residing substantially within the sliding storm sash;

an exterior ridge, wherein the two or more glass panes of the first pane assembly are rectangular and the exterior ridge resides around at least three sides of the first pane assembly and projects exteriorly 0.25 inch to 0.50 inch beyond the peripheral flange; and a peripheral flange, the peripheral flange extending radially outwardly beyond the exterior ridge around a storm window assembly periphery, and having a flange thickness in a range of approximately 1.0625 inch to 1.125 inch, the flange thickness residing along an interior-exterior axis;

installing the storm window assembly in a vintage wood window, the vintage wood window including:

an exterior jam track, the exterior jam track being bounded on an exterior side by an exterior stop and on an interior side by a parting stop;

a receiving shelf, the receiving shelf (i) being substantially horizontal, (ii) residing exteriorly from the outside jam track, and (iii) being bounded on an interior side by an exterior stop;

an exterior sash, the exterior sash comprising a glass pane and being adapted to slide along the exterior jam track;

an interior sash, the interior sash comprising a glass pane and being adapted to slide along the interior jam track; and opening the storm window assembly by lifting the sliding storm sash, the sliding storm sash sliding in a linear tack during the lifting.

* * * * *